US005364289A

United States Patent [19]

Noguchi et al.

[11] Patent Number: 5,364,289

[45] Date of Patent: Nov. 15, 1994

[54] RETRACTABLE WIRE HOLDER FOR ELECTRIC UNIT

[75] Inventors: Yoshitaka Noguchi; Masaaki Mizuguchi, both of Shizuoka, Japan

[73] Assignee: Yamaha Corporation, Japan

[21] Appl. No.: 154,184

[22] Filed: Nov. 18, 1993

[30] Foreign Application Priority Data

Nov. 27, 1992 [JP] Japan ..... 4-341158

[51] Int. Cl.[5] ..... H01R 13/72

[52] U.S. Cl. ..... 439/501; 24/129 B

[58] Field of Search ..... 439/501; 248/52; 24/129 R, 129 A, 129 B, 130

[56] References Cited

U.S. PATENT DOCUMENTS 4,092,075 5/1978 Kimball ..... 24/129 B

*Primary Examiner*—Gary F. Paumen

*Attorney, Agent, or Firm*—Ostrolenk, Faber, Gerb & Soffen

[57] ABSTRACT

An electric unit is powered by an external electric power source through a flexible wire plugged into a socket of the external electric power source, and the flexible wire is wound around a retractable winder after the flexible wire is pulled out, wherein the wire-winder is retracted into a space occupied by the electric unit so that the occupied space is decreased without impairment of the external appearance.

5 Claims, 2 Drawing Sheets

RETRACTABLE WIRE HOLDER FOR ELECTRIC UNIT

FIELD OF THE INVENTION

This invention relates to an electric unit and, more particularly, to a wire holder incorporated in the electric unit for a flexible wire.

DESCRIPTION OF THE RELATED ART

An electric unit such as a tuner or a synthesizer is powered with an external power source, and electric power is supplied from a socket through a plug-in flexible wire. An operator plugs the flexible wire into the socket, and, then, starts the electric unit to play music, by way of example.

However, when the electric unit is inoperative, the flexible wire is pulled out. If the flexible wire is left on the floor there is danger that, a person's foot may get caught in the flexible wire. For this reason, the electric unit is usually equipped with a wire-winder fixed to the body thereof. After the performance, the operator winds the flexible wire on the winder, thereby preventing an accident.

The prior art wire-winder is stationary on the body of the electric unit, and is usually provided on a rear panel of the body. The wire-winder projects rearwardly from the rear panel of the body, and the operator winds the flexible wire around the winder. Because the wire-winder projects rearwardly from the body, it requires a space between the rear panel and a wall of the room in which it is being used and, moreover, the winding operation requires still more space for the operator. This means that the prior art electric musical instrument occupies a substantial amount of area.

If, on the other hand, the wire-winder is provided on a side panel or a front panel of the electric musical instrument, then space is not required between the rear panel and the wall of the room. However, the wire-winder projecting from the body is an eyesore, and impairs the external appearance of the electric unit.

SUMMARY OF THE INVENTION

It is therefore an important object of the present invention to provide an electric unit which occupies a small amount of area without deterioration of the external appearance.

To accomplish the object, the present invention proposes to make a wire holder retractable.

In accordance with the present invention, there is provided an electric unit powered by an external power source, comprising: a case housing electric components therein, and having a front surface and a rear surface; a flexible wire plugged into the external power source, and supplying electrical power to the electric components; and a wire holder projecting from the rear surface for holding the flexible wire, and retractable into a predetermined space occupied by the case.

BRIEF DESCRIPTION OF THE DRAWINGS

The features and advantages of the electric unit according to the present invention will be more clearly understood from the following description taken in conjunction with the accompanying drawings in which.

DESCRIPTION OF THE PREFERRED EMBODIMENTS

First Embodiment

Figure 1:
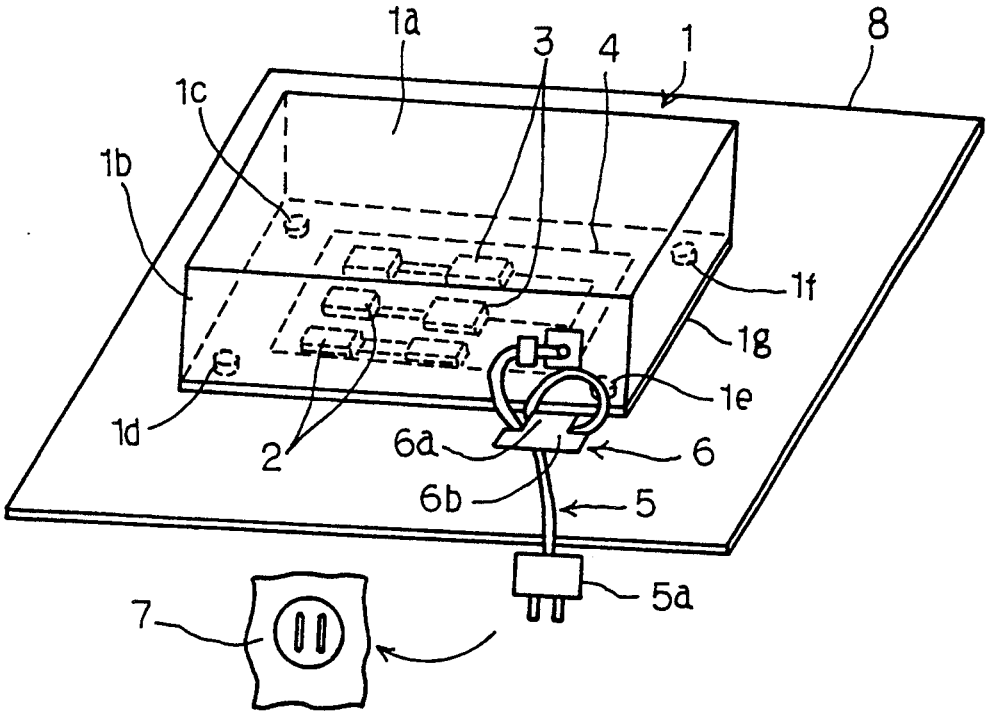
FIG. 1 is a perspective view showing a controller according to the present invention.

Referring first to FIG. 1 of the drawings, a controller for an electronic percussion system embodying the present invention comprises a case 1, integrated circuit devices 2 as well as discrete devices 3 mounted on a printed circuit board 4, a flexible wire 5 and a retractable wire-winder 6.

The case 1 has a front panel 1*a* and a rear panel 1*b*, which define an inner space therein. The printed circuit board 4 is housed in the inner space of the case, and is electrically connected with the flexible wire 5. The flexible wire 5 has a plug unit 5*a* at the leading end thereof, and the plug unit 5*a* is plugged into a socket 7 for supplying electric power through the flexible wire 5 to the printed circuit board 4.

Four cushion buttons 1*c*, 1*d*, 1*e* and 1*f* are fixed at four corners of the bottom panel 1*g* of the case 1, and form a gap between the bottom panel 1*g* and an upper surface of a suitable plate board member 8. The inner space of the case 1 and the space between the board member 8 and the bottom panel 1*g* each constitute a predetermined space occupied by the case.

The retractable wire-holder 6 has a generally T-shaped configuration, and is constituted by a relatively narrow boss portion 6*a* and a relatively wide leading portion 6*b* merged into the boss portion 6*a*. In this instance, the retractable wire-holder 6 is formed of plastic or metal. As will be better seen from FIG. 2, the boss portion 6*a* has a small aperture, and a plastic rivet 6*c* is fixed through the small aperture to the bottom panel 1*g*. As a result, the retractable wire-holder 6 is pivotable around the plastic rivet 6*c*, and is moved into and out of the space between the bottom panel 1*g* and the board member 8.

Figure 2:
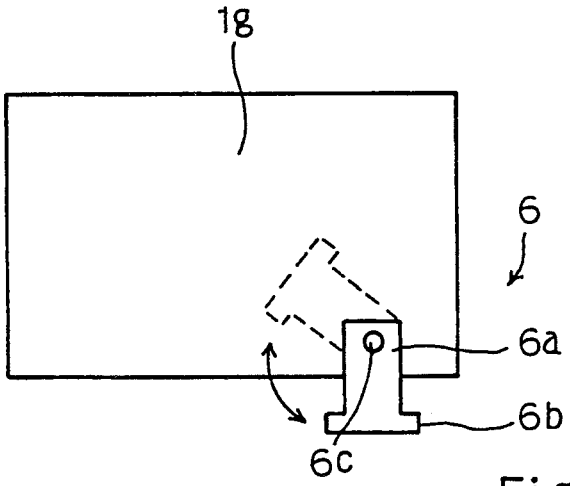
FIG. 2 is a bottom view showing a retractable wire-holder incorporated in the controller according to the present invention.

When the controller is inoperative, the retractable wire-holder 6 is pivoted out from the space as indicated by the solid line in FIG. 2, and the flexible wire 5 is wound around the boss portion 6*a* of the retractable wire-holder 6 as shown in FIG. 1. The leading portion 6*b* does not allow the wound flexible wire 5 to escape from the boss portion 6*a*. Therefore, the flexible wire 5 is held on the rear panel 1*b*, and does not cause a person to be tripped.

On the other hand, when the controller is powered for use, the flexible wire 5 is loosened, and is extended from the rear panel 1*b*. The plug unit 5*a* is plugged into the socket 7, and electric power is supplied to the printed circuit board 4. The wire-holder 6 is pivoted into the position indicated by the broken line in FIG. 2, wherein it is retracted into the space between the bottom panel 1*g* and the suitable board member 8. Therefore, the wire-holder is not an eyesore, and the controller can be placed on the board member 8 as close to a wall as possible. Thus, the controller according to the present invention occupies a smaller amount of area compared to the prior art electric unit, and the retracted wire-holder enhances the external appearance of the controller.

Second Embodiment

Figure 3:
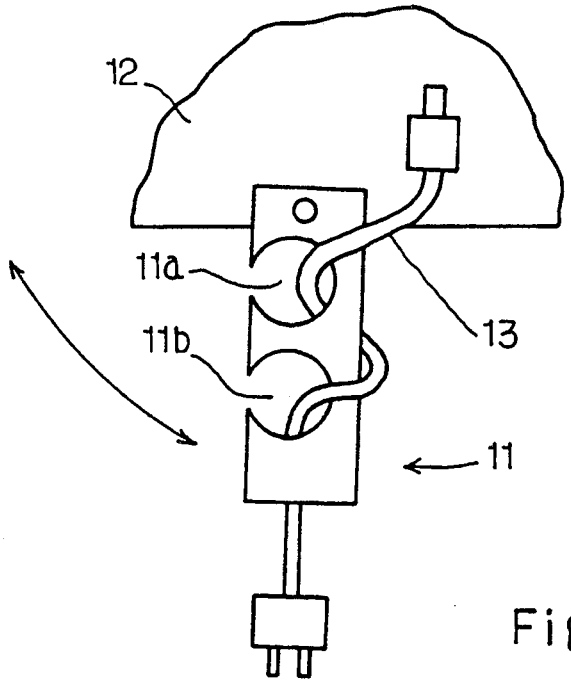
FIG. 3 is a bottom view showing another retractable wire-holder according to the present invention.

Turning to FIG. 3 of the drawings, another retractable wire-holder 11 embodying the present invention is pivotally connected with a bottom panel 12 of an electric unit, and a flexible wire 13 is held by the retractable wire-holder.

The retractable wire-holder 11 is formed from a rectangular plate member, and two large apertures 11*a* and 11*b* are formed in the rectangular plate member. The two apertures 11*a* and 11*b* are open to a side edge of the rectangular plate member, and allow the flexible wire 13 to pass therethrough.

For this reason, the flexible wire 13 can get tied to the retractable wire-holder 11 while the electric unit is standing idle. When the electric unit is used, the flexible wire 13 is untied from the retractable wire-holder 11, and supplies electric power from an external source to a circuit component housed in the case. While the flexible wire is supplying the electric power, the wire-holder 11 is retracted into a space beneath the bottom panel 12.

The retractable wire-holder thus arranged also decreases the area occupied by the electric unit without impairing its the external appearance.

Third Embodiment

Figure 4:
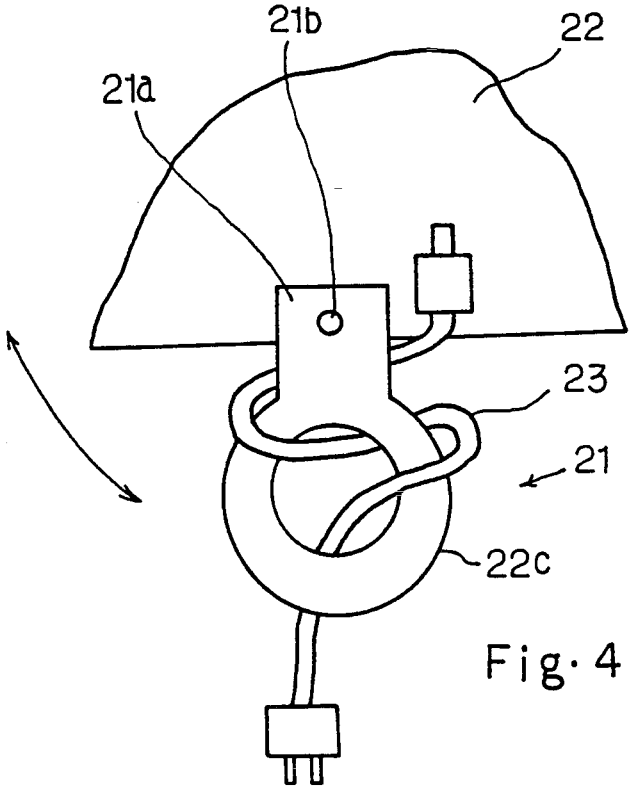
FIG. 4 is a bottom view showing yet another retractable wire-holder according to the present invention.

Turning to FIG. 4 of the drawings, yet another retractable wire-holder 21 embodying the present invention is pivotally supported by a bottom panel 22 of a case of an electric unit. The retractable wire-holder 21 has a boss portion 21*a* connected by means of a plastic rivet 21*b* with the bottom panel 22 and a ring portion 22*c* retractable into a space beneath the bottom panel 22.

When a flexible wire 23 is not powering the electric unit, the flexible wire 23 can get tied to the ring portion 22*c* projecting from the space. On the other hand, the wire-holder 21 is retracted into the space when the flexible wire supplies electric power to the electric unit. Therefore, all of the advantages of the retractable wire-holder 6 are also achieved by the retractable wire-holder 21 implementing the third embodiment.

As will be appreciated from the foregoing description, the retracted wire-holder according to the present invention allows the electric unit to occupy a small amount of area, and the wire-holder projecting from the rear panel does not impair the external appearance of the electric unit.

Although particular embodiments of the present invention have been shown and described, it will be obvious to those skilled in the art that various changes and modifications may be made without departing from the spirit and scope of the present invention. For example, the retractable wire-holder according to the present invention is employable in any electric unit powered from an external power source such as, for example, an audio-tuner or a desk/knee top computer system. Moreover, the retractable wire-holder may slide into and out of a space beneath the bottom panel of an electric unit, or may be retracted into an inner space of the electric unit.

What is claimed is:

1. An electric unit powered by an external power source, comprising:

a case housing electric components therein, and having a front surface and a rear surface;

a flexible wire plugged into said external power source, and supplying electrical power to said electric components; and a wire holder projecting from said rear surface for holding said flexible wire, and retractable into a predetermined space occupied by said case.

2. The electric unit as set forth in claim 1, in which said wire holder is pivotally connected with a bottom panel of said case.

3. The electric unit as set forth in claim 1, in which said wire holder has a narrow boss portion pivotally connected with a bottom panel of said case and a wide leading end portion laterally projecting from said boss portion.

4. The electric unit as set forth in claim 1, in which said wire holder has apertures open to an side edge thereof for allowing said flexible wire to get caught therein.

5. The electric unit as set forth in claim 1, in which said wire holder has a boss portion pivotally connected with a bottom panel of said case and a ring portion contiguous to said boss portion.

* * * * *